US011244530B2

(12) United States Patent
Zheng et al.

(10) Patent No.: US 11,244,530 B2
(45) Date of Patent: Feb. 8, 2022

(54) AUTOMATIC TELLER MACHINE AND BANKNOTE PROCESSING METHOD

(71) Applicant: Shandong New Beiyang Information Technology Co., Ltd., Shandong (CN)

(72) Inventors: Lei Zheng, Shandong (CN); Zhenxing Zhao, Shandong (CN); Bingqing Liu, Shandong (CN); Chuntao Wang, Shandong (CN)

(73) Assignee: Shandong New Beiyang Information Technology Co., Ltd., Shandong (CN)

( * ) Notice: Subject to any disclaimer, the term of this patent is extended or adjusted under 35 U.S.C. 154(b) by 238 days.

(21) Appl. No.: 16/486,138

(22) PCT Filed: Feb. 9, 2018

(86) PCT No.: PCT/CN2018/075977
§ 371 (c)(1),
(2) Date: Aug. 14, 2019

(87) PCT Pub. No.: WO2018/149366
PCT Pub. Date: Aug. 23, 2018

(65) Prior Publication Data

US 2020/0234525 A1 Jul. 23, 2020

(30) Foreign Application Priority Data

Feb. 15, 2017 (CN) ..... 201710081511.4

(51) Int. Cl.
*G07D 11/16* (2019.01)
*G07D 11/18* (2019.01)
(Continued)

(52) U.S. Cl.
CPC ..... *G07D 11/16* (2019.01); *G07D 11/13* (2019.01); *G07D 11/14* (2019.01); *G07D 11/18* (2019.01);
(Continued)

(58) Field of Classification Search
CPC ..... G07D 11/10–18
See application file for complete search history.

(56) References Cited

U.S. PATENT DOCUMENTS 6,422,458 B1 * 7/2002 Katou ..... B65H 1/025 235/379
8,689,962 B2 * 4/2014 Mizoro ..... G07D 11/13 194/206
(Continued)

FOREIGN PATENT DOCUMENTS

CN 101147176 A 3/2008
CN 102859558 A 1/2013
(Continued)

OTHER PUBLICATIONS

International Search Report dated Apr. 26, 2018, in the International Application No. PCT/CN2018/075977, 5 pages.
(Continued)

*Primary Examiner* — Christle I Marshall
(74) *Attorney, Agent, or Firm* — Wilmer Cutler Pickering Hale and Dorr LLP

(57) ABSTRACT

An automatic teller machine includes a banknote conveyance channel, a banknote recycling channel, and a banknote circulation channel. The banknote conveyance channel includes an annular channel, a first branch channel, a second branch channel, a third branch channel, a fourth branch channel, and a fifth branch channel. A banknote-in mechanism communicates with the annular channel via the first branch channel. A temporary storage mechanism communicates with the annular channel via the second branch channel. A banknote-out mechanism communicates with the annular channel via the third branch channel. Two ends of an identification mechanism communicate with the annular channel via the fourth branch channel and the fifth branch channel, respectively. A recycling box communicates with
(Continued)

the banknote conveyance channel via the banknote recycling channel. A circulation box communicates with the banknote circulation channel via the banknote circulation channel.

18 Claims, 8 Drawing Sheets

(51) Int. Cl.
*G07D 11/13* (2019.01)
*G07D 11/14* (2019.01)
*G07D 7/181* (2016.01)

(52) U.S. Cl.
CPC ..... *G07D 7/181* (2017.05); *G07D 2207/00* (2013.01); *G07D 2211/00* (2013.01)

(56) References Cited

U.S. PATENT DOCUMENTS 8,733,531 B2 * 5/2014 Iwamura ..... B65H 29/006 194/206
8,756,158 B2 * 6/2014 Colvin ..... G07D 11/36 705/43
10,109,134 B2 * 10/2018 Jeong ..... G07D 11/245
2020/0160644 A1 * 5/2020 Zhao ..... G07D 11/40

FOREIGN PATENT DOCUMENTS

| | | | | |
|---|---|---|---|---|
| JP | S63-106893 | A | | 5/1988 |
| JP | H09-128646 | A | | 5/1997 |
| JP | 09223256 | A | * | 8/1997 |
| JP | H09-223256 | A | | 8/1997 |
| JP | 2001-023000 | A | | 1/2001 |
| JP | 2010-277210 | A | | 12/2010 |
| JP | 2017-13906 | A | | 1/2017 |
| JP | 2017013906 | A | * | 1/2017 |

OTHER PUBLICATIONS

European Search Report dated Dec. 23, 2020, in application No. 18754027.3. 12 pages.

* cited by examiner

--Prior Art--

AUTOMATIC TELLER MACHINE AND BANKNOTE PROCESSING METHOD

CROSS-REFERENCE TO RELATED APPLICATIONS

This application is a U.S. National Phase Application of International Patent Application number PCT/CN2018/075977, filed on Feb. 9, 2018, which claims the priority of China Patent Application No. 201710081511.4, titled "Automatic Teller Machine and Banknote Processing Method," and filed Feb. 15, 2017 before the State Intellectual Property Office of People's Republic of China, disclosures of both of which are hereby incorporated herein by reference in their entireties.

TECHNICAL FIELD

The present disclosure relates to financial self-service devices, for example, an automatic teller machine and a banknote processing method.

BACKGROUND

FIG. 1 shows a structural schematic diagram of an automatic teller machine provided in the related art. As shown in FIG. 1, the automatic teller machine includes a banknote-in mechanism 11', a banknote-out mechanism 12', a temporary storage mechanism 13', an identification mechanism 2', a plurality of circulation boxes 3', a recycling box 5', a plurality of conveyance channels connected between the above mechanisms, the circulation boxes 3' and the recycling box 5'. A switching member 49' is arranged at an intersection between the conveyance channels.

In performing a banknote deposit operation, a banknote is put in the banknote-in mechanism 11', and then conveyed via the second channel 42' and the sixth channel 46 in sequence to identification mechanism 2' to be identified by the identification mechanism 2'. If the banknote is identified by the identification mechanism 2' as a qualified banknote, then it would be conveyed via the fourth channel 44', the fifth channel 45', the sixth channel 46', the first channel 41', and the third channel 43', to arrive at the temporary storage mechanism 13' and temporarily stored there. If the banknote is identified by the identification mechanism 2' as an unqualified banknote, then it would be conveyed via the fourth channel 44', the fifth channel 45', the sixth channel 46', and the first channel 41' to arrive at the banknote-out mechanism 11', and to be taken back by the user.

If it is confirmed to perform a banknote deposit operation, then the banknotes temporarily stored in the temporary storage mechanism 13' would be conveyed one by one to the third channel 43', then move along the first channel 41' and the sixth channel 46' in sequence, and then conveyed back again to the identification mechanism 2' for banknote authentication. The banknote that is identified to be qualified would sequentially move along the fourth channel 44' and the eighth channel 48', and then conveyed to the main channel 85' via the first branch 103', and then conveyed to the corresponding circulation box 3' along the main channel 85' and stored therein. If the banknote deposit operation is canceled, then the door of the temporary storage mechanism 13' would be opened, and the banknote temporarily stored there would be taken away.

In performing a banknote withdrawal operation, the banknotes in the circulation box 3' would be sequentially output one by one. The banknote would move along the main channel 85', the first branch 103', the eighth channel 48', and the fourth channel 44' in sequence, along a direction opposite to the conveying direction in the banknote deposit operation, so as to be conveyed to the identification mechanism 2' for authentication. The banknote that is identified by the identification mechanism 2' to be qualified would move to the banknote-out mechanism 12' along the sixth channel 46' and the first channel 41' in sequence. The banknote that is identified by the identification mechanism 2' to be unqualified would move to the recycling box 5' along the sixth channel 46', the seventh channel 47', and the second branch 104' in sequence and stored therein.

Such automatic teller machines have the following problem. The banknote-in mechanism 11', the banknote-out mechanism 12', the temporary storage mechanism 13', and the identification mechanism 2' are all in communication with the sixth channel 46', such that in both the banknote deposit and withdrawal operations, all the banknotes need to pass through the sixth channel 46'. Because the banknotes are conveyed bidirectionally in the sixth channel 46', the bidirectional conveyance of banknote in the conveyance channel can easily get jammed.

SUMMARY

Provided is an automatic teller machine, which reduces the probability of jamming during the banknote conveyance and improves the banknote processing efficiency.

Further provided is a banknote processing method based on the above automatic teller machine.

Provided is an automatic teller machine, including a banknote-in mechanism, a temporary storage mechanism, a banknote-out mechanism, an identification mechanism, a circulation box, a recycling box, a banknote conveyance channel, a banknote recycling channel, and a banknote circulation channel.

The banknote conveyance channel includes an annular channel, a first branch channel, a second branch channel, a third branch channel, a fourth branch channel, and a fifth branch channel.

The banknote-in mechanism is in communication with the annular channel through the first branch channel.

The temporary storage mechanism is in communication with the annular channel through the second branch channel.

The banknote-out mechanism is in communication with the annular channel through the third branch channel.

A first end of the identification mechanism is in communication with the annular channel through the fourth branch channel, and a second end of the identification mechanism is in communication with the annular channel through the fifth branch channel.

The recycling box is in communication with the banknote conveyance channel through the banknote recycling channel.

The circulation box is in communication with the banknote conveyance channel through the banknote circulation channel.

In one embodiment, the annular channel is configured to make a banknote to unidirectionally move in the annular channel along a preset direction.

In one embodiment, at least one selected from the group consisting of the banknote-in mechanism, the temporary storage mechanism, and the banknote-out mechanism is located outside of the annular channel.

In one embodiment, the fifth branch channel, the fourth branch channel, the third branch channel, the second branch channel and the first branch channel are in communication with the annular channel in sequence along the preset direction.

In one embodiment, the annular channel includes a fourth path, a third path, a second path and a first path which are connected end to end along the preset direction.

The first branch channel and the first path intersect. The second branch channel, the first path and the second path intersect. The third branch channel, the second path and the third path intersect. The third path, the fourth path and the fourth branch channel intersect. The first path, the fourth path and the fifth branch channel intersect.

In one embodiment, the recycling box is in communication with the third branch channel through the banknote recycling channel.

In one embodiment, the third branch channel includes a fifth path and a sixth path.

A first end of the fifth path, a first end of the sixth path and the banknote recycling channel intersect. A second end of the fifth path and the annular channel intersect. A second end of the sixth path is in communication with the banknote-out mechanism.

In one embodiment, the circulation box is in communication with the fourth branch channel through the banknote circulation channel.

In one embodiment, a first switching member is arranged at an intersection of the second branch channel and the annular channel. The first switching member is configured to communicate the second branch channel with a portion of the annular channel located at a first side of the second branch channel, or communicate the second branch channel with a portion of the annular channel located at a second side of the second branch channel.

In one embodiment, the third branch channel comprises a fifth path, and a second switching member is arranged at an intersection of fifth path, the second path, and the third path. The second switching member is configured to communicate the fifth path and the third path, or communicate the second path with the third path.

In one embodiment, a third switching member is arranged at an intersection of the fourth branch channel, the third path, and the fourth path. The third switching member is configured to communicate the third path with the fourth path, or communicate the fourth branch channel and the third path.

In one embodiment, a fourth switching member is arranged at an intersection of the fifth branch channel and the annular channel. The fourth switching member is configured to communicate the fifth branch channel with a portion of the annular channel located at a first side of the fifth branch channel, or communicate the fifth branch channel with a portion of the annular channel located at a second side of the fifth branch channel.

In one embodiment, a fifth switching member is arranged at an intersection of the banknote recycling channel and the banknote conveyance channel. The fifth switching member is configured to block off the banknote conveyance channel, or block off a communication between the banknote recycling channel and the banknote conveyance channel.

In one embodiment, a sixth switching member is arranged at an intersection of the banknote circulation channel and the banknote conveyance channel. The sixth switching member is configured to block off the banknote conveyance channel, or block off a communication between the banknote circulation channel and the banknote conveyance channel.

In one embodiment, at least one selected from the group consisting of a first switching member, a second switching member, a third switching member, a fourth switching member, a fifth switching member, and a sixth switching member is a rotary switching member.

Provided is a banknote processing method, implemented on the basis of any one of an automatic teller machine discussed above, including banknote deposit steps and banknote withdrawal steps. A banknote moves unidirectionally all along in the annular channel along a preset direction when the banknote is located in the annular channel.

The banknote deposit steps include the following process.

The banknote enters the annular channel from the banknote-in mechanism through the first branch channel. The banknote enters the fifth branch channel through the annular channel, and then enters the identification mechanism along the fifth branch channel. After being identified by the identification mechanism, the banknote enters the annular channel along the fourth branch channel. If the banknote is identified by the identification mechanism as meeting a first preset condition, the banknote would enter the second branch channel through the annular channel, and then enters the temporary storage mechanism along the second branch channel. If the banknote is identified by the identification mechanism as not meeting the first preset condition, then the banknote would enter the third branch channel through the annular channel, and then enters the banknote-out mechanism along the third branch channel.

When the banknote deposit operation is canceled, a door of the temporary storage mechanism is opened.

When the banknote deposit operation is confirmed, the banknote enters the annular channel from the temporary storage mechanism through the second branch channel. The banknote then enters the fifth branch channel through the annular channel, and enters the identification mechanism along the fifth branch channel. If the banknote is identified by the identification mechanism as meeting a second preset condition, then the banknote would enter the banknote circulation channel through the banknote conveyance channel, and then enter the circulation box along the banknote circulation channel. If the banknote is identified by the identification mechanism as not meeting the second preset condition, then the banknote would enter the annular channel through the banknote conveyance channel, then enter the banknote recycling channel along the annular channel, and enters the recycling box along the banknote recycling channel.

The banknote withdrawal steps include the following process.

The banknote enters the banknote conveyance channel from the circulation box through the banknote circulation channel, and then enters the identification mechanism along the banknote conveyance channel. If the banknote is identified by the identification mechanism as meeting the second preset condition, then the banknote would enter the annular channel through the fifth branch channel, then enter the third branch channel through the annular channel, and then enter the banknote-out mechanism along the third branch channel. If the banknote is identified by the identification mechanism as not meeting the second preset condition, then the banknote would enter the annular channel through the banknote conveyance channel, then enter the banknote recycling channel along the annular channel, and then enter the recycling box along the banknote recycling channel.

In one embodiment, the banknote deposit steps further include at least one selected from the group consisting of the following options:

the option in which if the banknote is identified by the identification mechanism as meeting the first preset condition, the banknote enters the banknote circulation channel through the fourth branch channel; and the option in which if the banknote is identified by the identification mechanism as not meeting the first preset condition, the banknote enters the annular channel through the fourth branch channel, then enters the third branch channel through the annular channel, and then enters the banknote recycling channel along the third branch channel.

In the banknote withdrawal steps, the process in which the banknote enters the banknote conveyance channel from the circulation box through the banknote circulation channel, then enters the identification mechanism along the banknote conveyance channel includes the following process in which the banknote enters the fourth branch channel from the circulation box through the banknote circulation channel, and then enters the identification mechanism along the fourth branch channel.

The process of "if the banknote is identified by the identification mechanism as not meeting the second preset condition, the banknote enters the annular channel through the banknote conveyance channel, and then enters the banknote recycling channel along the annular channel, and then enters the recycling box along the banknote recycling channel" includes the following process.

If the banknote is identified by the identification mechanism as not meeting the second preset condition, the banknote enters the annular channel through the fifth branch channel, then enters the third branch channel through the annular channel, and then enters the banknote recycling channel along the third branch channel.

Further provided is a computer readable storage medium, storing computer executable instructions configured to perform any one of the methods discussed above.

According to the automatic teller machine provided by the present disclosure, the banknote-in mechanism, the temporary storage mechanism, the banknote-out mechanism, and the identification mechanism are all communicated to the annular channel. In performing banknote deposit and withdrawal operations, the banknote can keep moving unidirectionally in the annular channel along a preset direction, so as to achieve banknote circulation between the banknote-in mechanism, the temporary storage mechanism, the banknote-out mechanism, the identification mechanism, the circulation box, and the recycling box, thereby reducing the probability of jamming during the banknote conveyance and improving the banknote processing efficiency.

According to the banknote processing method provided by the present disclosure, when the banknote is in the annular channel, the banknote keeps moving unidirectionally in the annular channel along the preset direction, so as to achieve banknote circulation between the banknote-in mechanism, the temporary storage mechanism, the banknote-out mechanism, the identification mechanism, the circulation box and the recycling box, thereby reducing the probability of jamming during the banknote conveyance and improving the banknote processing efficiency.

Drawing numerals: 2'—identification mechanism; 3'—Circulation box; 5'—Recycling box; 11'—Banknote-in mechanism; 12'—Banknote-out mechanism; 13'—Temporary storage mechanism; 41'—First channel; 42'—Second channel; 43'—Third channel; 44'—Fourth channel; 45'—Fifth channel; 46'—Sixth channel; 47'—Seventh channel; 48'—Eighth channel; 49'—Switching member; 85'—Main channel; 103'—First branch; 104'—Second branch; 10—Automatic teller machine; 110—Banknote-in mechanism; 120—Temporary storage mechanism; 121—Door; 130—Banknote-out mechanism; 131—Door; 140—identification mechanism; 150—Circulation box; 160—Recycling box; 200—Banknote conveyance channel; 201—Channel plate; 202—Channel space; 203—Roller; 210—First branch channel; 220—Second branch channel; 230—Third branch channel; 231—Fifth path; 232—Sixth path; 240—Fourth branch channel; 250—Fifth branch channel; 260—Annular channel; 261—First path; 262—Second path; 263—Third path; 264—Fourth path; 300—Banknote recycling channel; 400—Banknote circulation channel; 601—First switching member; 602—Second switching member; 603—Third switching member; 604—Fourth switching member; 605—Fifth switching member; 606—Sixth switching member.

DETAILED DESCRIPTION

In the description of the embodiments of the present disclosure, terms such as "first" and "second" are used for distinguishing purposes, and are not to be construed as indicating or implying relative importance.

Figure 1:
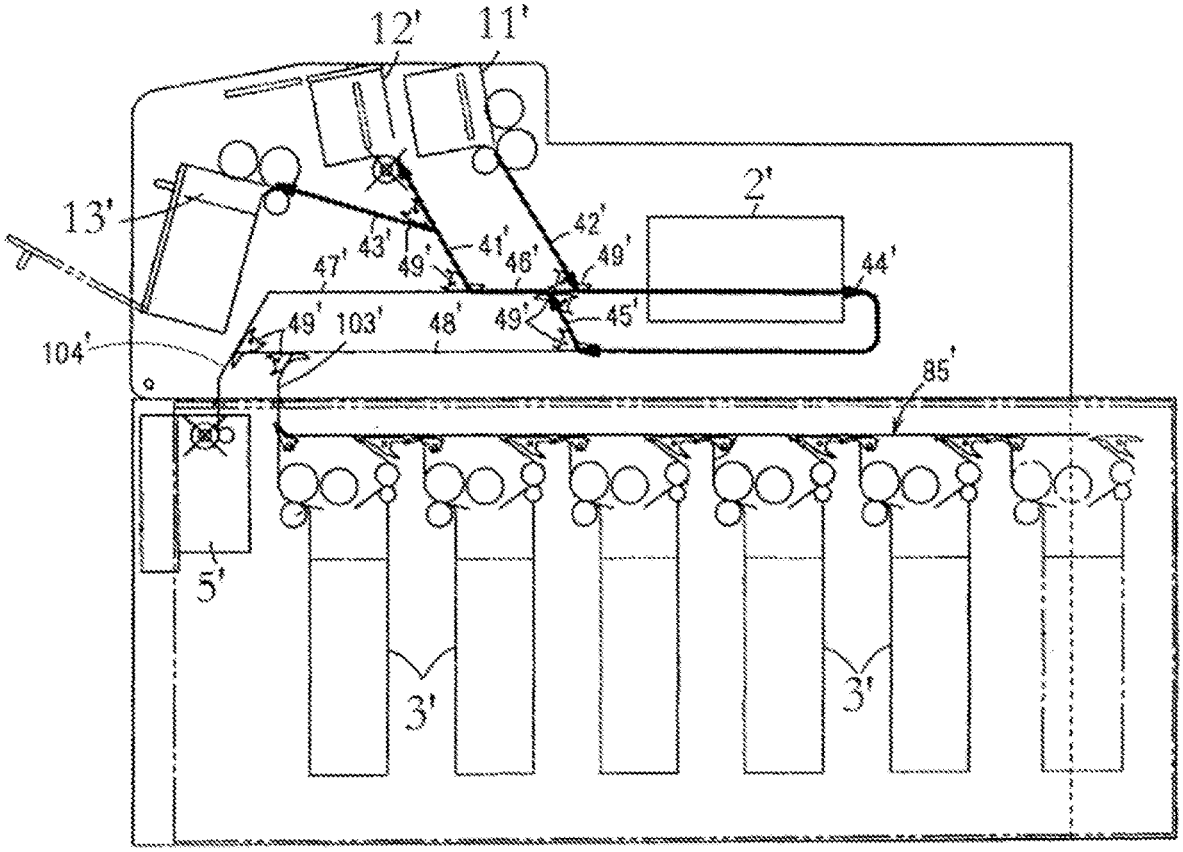
FIG. 1 is a structural schematic view of an automatic teller machine provided in the related art.
Figure 2:
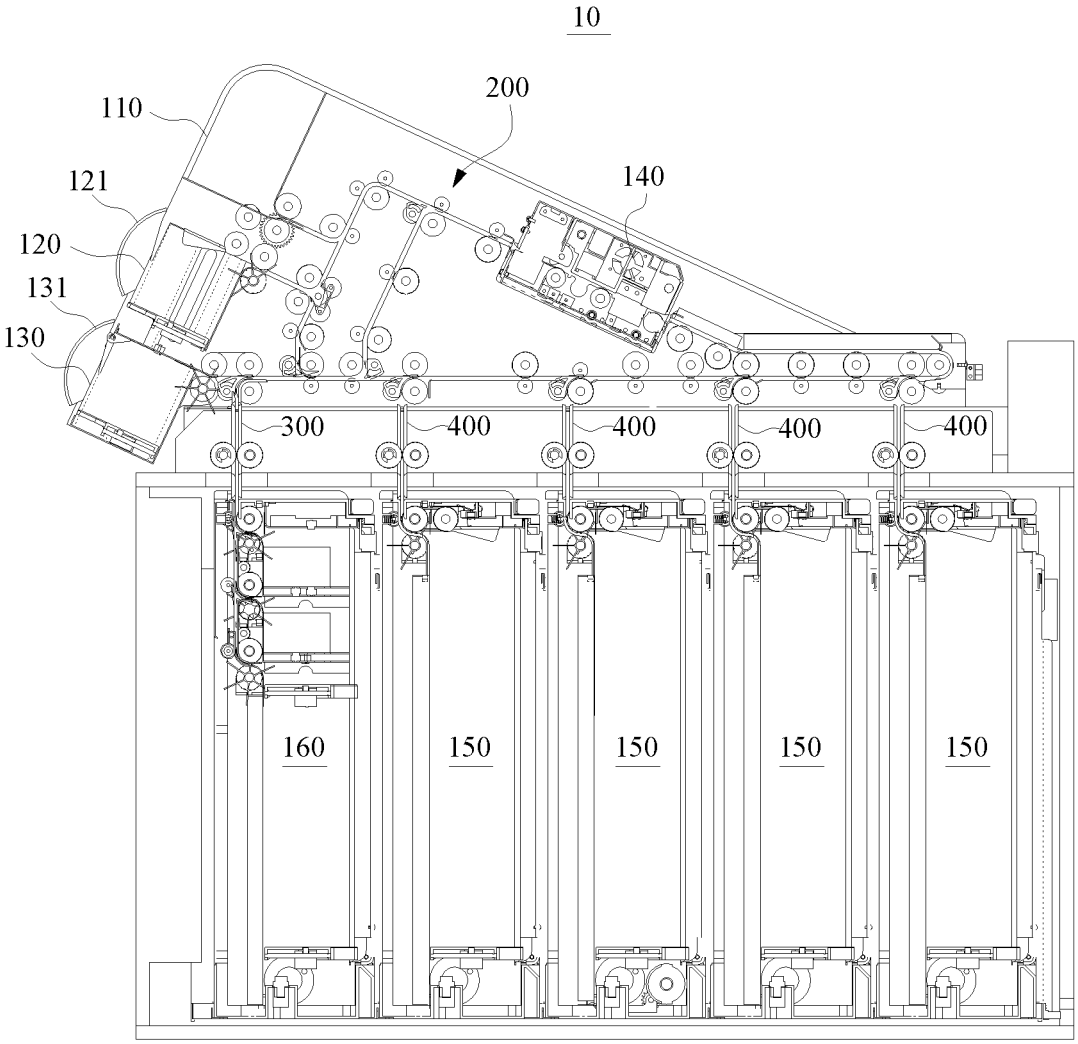
FIG. 2 is a structural schematic view of an automatic teller machine in accordance with one embodiment.

Referring to FIG. 2, which is structural schematic view of an automatic teller machine 10 according to one embodiment. As illustrated in FIG. 2, the automatic teller machine 10 includes a banknote-in mechanism 110, a temporary storage 120, a banknote-out mechanism 130, an authentication mechanism 140, a circulation box 150, a recycling box 160, a banknote conveyance channel 200, a banknote collection channel 300, and a banknote circulation channel 400.

The banknote-in mechanism 110 is configured to transfer the banknotes placed by the user to the identification mechanism 140 one by one. The temporary storage 120 is configured to temporarily store the banknotes that are identified by the identification mechanism 140 as qualified banknotes during a deposit operation. The temporary mechanism 120 is provided with a first door 121 configured to close or open a banknote storage area of the temporary storage mechanism 120. When the first door 121 is opened, the user can take out the banknotes in the temporary storage 120. The banknote-out mechanism 130 is configured to dispense the banknotes for the user to withdraw. The banknote-out mechanism 130 is provided with a second door 131 configured to close or open a banknote storage area of the banknote-out mechanism 130. The identification mechanism 140 is configured to identify the banknote to distinguish between a qualified banknote (namely a banknote that meets preset conditions) and an unqualified banknote (namely a banknote that fail to meet the preset conditions). In this embodiment, the preset conditions may include a first preset condition and a second preset condition, where the first preset condition may be a condition that whether the banknote is genuine or counterfeit, and the identification mechanism 140 is configured to detect the authenticity of the banknote to check whether it meets the first preset condition, that is, to identify a real banknote as a qualified banknote that meets the first preset condition, and a counterfeit or tampered banknote as an unqualified banknote that fails the first preset condition. The authenticate mechanism 140 is further configured to verify whether or not the banknote can be circulated to check whether it meets the second preset condition, that is, to identify the banknote that meets the circulation requirements (such as the degree of damage, the degree of aging, and version) as a qualified banknote that meets the second preset condition, and the banknote that does not meet the circulation requirements (such as the degree of damage, the degree of aging, and version) as an unqualified banknote, including an old version banknote, a damage banknote and the like that fails the second preset condition. The circulation box 150 is configured to store and dispense the banknote. The recycling box 160 is configured to store an unqualified banknote. In the present embodiment, the automatic teller machine 10 includes four circulation boxes 150 and one recycling box 160. The banknote is circulated between the banknote-in mechanism 110, the temporary storage mechanism 130, the banknote-out mechanism 130, the identification mechanism 140, the circulation boxes 150, and the recycling box 160 through the banknote conveyance channel 200, the banknote recycling channel 300, and the banknote circulation channel 400.

For sake of clarity, the term "circulated" and any variations thereof directed to the concept of "banknote circulation" refers to the operation that the banknote is moved around and among the banknote-in mechanism 110, the temporary storage mechanism 130, the banknote-out mechanism 130, the identification mechanism 140, the circulation boxes 150, and the recycling box 160, to accomplish a cash deposit or withdrawal operation.

Figure 3:
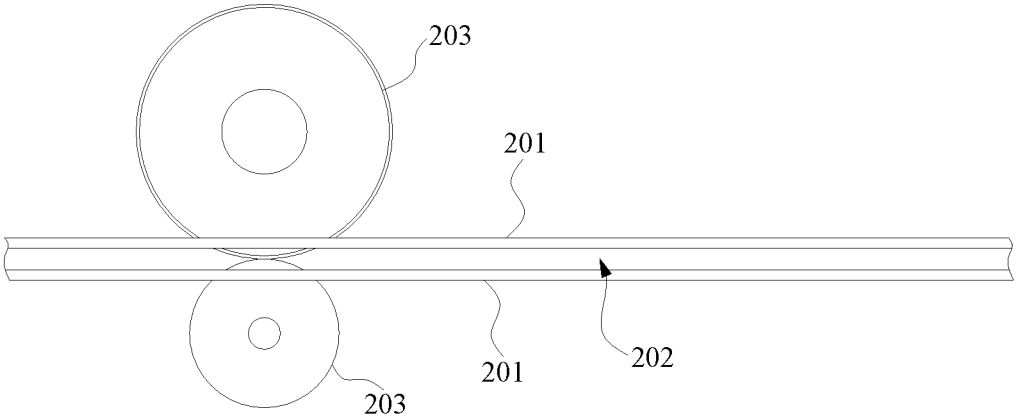
FIG. 3 is a partial structural schematic view of a banknote conveyance channel of an automatic teller machine in accordance with one embodiment.

In the present embodiment, the banknote conveyance channel 200, the banknote recycling channel 300 and the banknote circulation channel 400 all adopt the same working principle. Referring to FIG. 3, which is a partial structural schematic view of a banknote conveyance channel 200 according to one embodiment. Taking FIG. 3 as an example, the following is an illustration of the working principle of the banknote conveyance channel 200, the banknote recycling channel 300 and the banknote circulation channel 400. Two channel plates 201 are arranged at opposite intervals. A channel space 202 which is elongated and configured to accommodate the banknote is formed between the two channel plates 201. Two sides of the channel space 202 are respectively provided with one roller 203. The banknote passes through a gap between the two rollers 203, and circumferential surfaces of the two rollers 203 are respectively in contact with two surfaces of the banknote. When the roller 203 rotates, the banknote is driven to move in the channel space 202 by means the friction between the circumferential surface of the roller 203 and the surface of the banknote.

Figure 4:
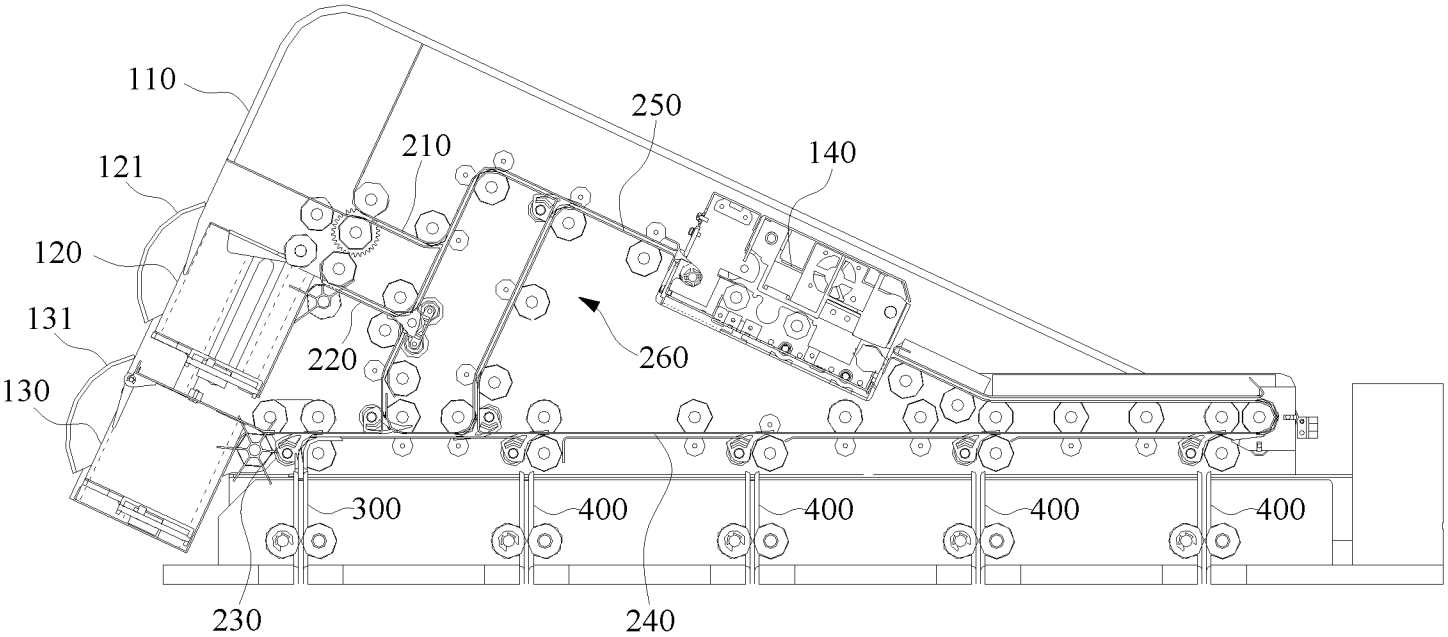
FIG. 4 is an enlarged partial structural schematic view of an automatic teller machine in accordance with one embodiment.

Referring to FIG. 4, which is an enlarged partial structural schematic view of FIG. 2. The circulation box 150 and the recycling box 160 shown in FIG. 2 are omitted in FIG. 4 to more clearly display the structure of the banknote conveyance channel 200. In the present embodiment, the banknote conveyance channel 200 includes a first branch channel 210, a second branch channel 220, a third branch channel 230, a fourth branch channel 240, a fifth branch channel 250, and an annular channel 260. The banknote-in mechanism 110 is in communication with the annular channel 260 through the first branch channel 210. The temporary storage mechanism 120 is in communication with the annular channel 260 through the second branch channel 220. The banknote-out mechanism 130 is in communication with the annular channel 260 through the third channel 230. Two ends of the identification mechanism 140 are respectively in communication with the annular channel 260 through the fourth channel 240 and the fifth channel 250. The recycling box 160 is in communication with the banknote conveyance channel 200 through the banknote recycling channel 300. The circulation box 150 is in communication with the banknote conveyance channel 200 through the banknote circulation channel 400. The annular channel 260 is used to enable the banknote to move unidirectionally in the annular channel 260 along a preset direction (namely, clockwise in the drawings). In the present embodiment, the order of arrangement of the first branch channel 210, the second branch channel 220, the third branch channel 230, the fourth branch channel 240, and the fifth branch channel 250 around the annular channel 260 may be arbitrary. In the present embodiment, in order to reduce the length of the moving path during the banknote circulation, the fifth branch channel 250, the fourth branch channel 240, the third branch channel 230, the second branch channel 220, and the first branch channel 210 are in communication with the annular channel 260 in sequence in the clockwise direction (namely, the preset direction) in FIG. 4. In the present embodiment, the banknote recycling channel 300 may be in communication with any one of the first branch channel 210, the second branch channel 220, the third branch channel 230, the fourth branch channel 240, the fifth branch channel 250, and the annular channel 260. The banknote circulation channel 400 may be in communication with any one of the first branch channel 210, the second branch channel 220, the third branch channel 230, the fourth branch channel 240, the fifth branch channel 250, and the annular channel 260. In the present embodiment, in order to reduce the length of the moving path during the banknote circulation, the banknote recycling channel 300 may be in communication with the third branch channel 230, and the banknote circulation channel 400 may be in communication with the fourth branch channel 240. In order to make the structure of the automatic teller machine 10 more compact, at least one selected from the group consisting of the banknote-in mechanism 110, the temporary mechanism 120, and the banknote-out mechanism 130 is located outside the annular channel 260. In the present embodiment, the banknote-in mechanism 110, the temporary storage mechanism 120, and the banknote-out mechanism 130 are all located outside the annular channel 260.

Figure 5:
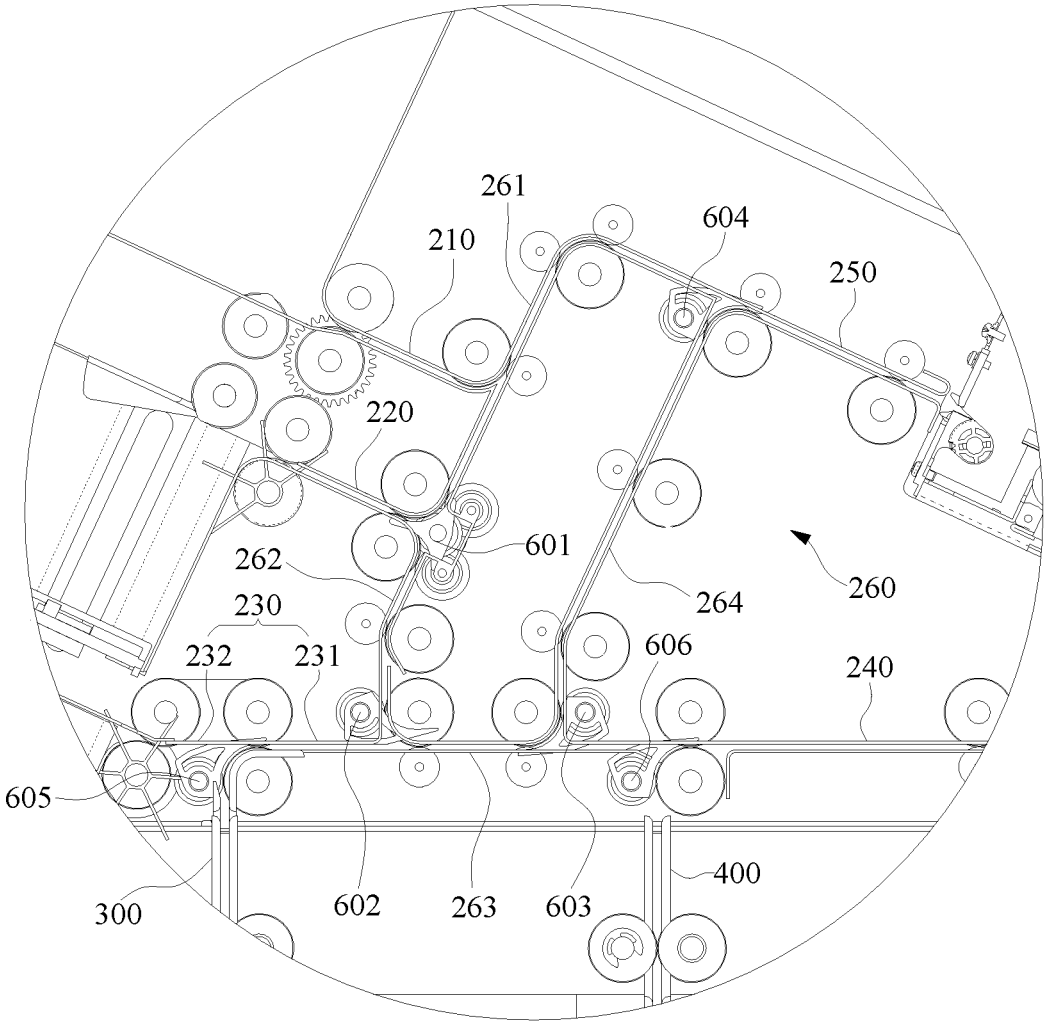
FIG. 5 is an enlarged partial structural schematic view of an annular channel of an automatic teller machine in accordance with one embodiment.

Referring to FIG. 5, which is an enlarged partial structural schematic view of an annular channel 260 in FIG. 4. In the present embodiment, the annular channel 260 includes a fourth path 264, a third path 263, a second path 262, and a first path 261 connected end to end in the clockwise direction (namely, the preset direction) in FIG. 4. The first branch channel 210 and the first path 261 intersect. The second branch channel 220, the first path 261, and the second path 262 intersect. The third branch channel 230, the second path 262, and the third path 263 intersect. The third path 263, the fourth path 264, and the fourth branch channel 240 intersect. The first path 261, the fourth path 264, and the fifth branch channel 250 intersect. In the present embodiment, the third branch channel 230 includes s fifth path 231 and a sixth path 232. A first end of the fifth path 231, a first end of the sixth path 232, and the banknote recycling channel 300 intersect. A second end of the fifth path 231, the second path 262, and the third path 263 intersect. A second end of the sixth path 232 is in communication with the banknote-out mechanism 130. In other embodiments, the annular channel 260 and the third branch channel 230 may adopt other structures, for example, the annular channel 260 and the third branch channel 230 both adopt an integral structure.

Referring to FIG. 5, during the banknote circulation, in order to ensure the banknote to move along the preset direction, a switching member is arranged at each of the intersections of the channels. In the present embodiment, a first switching member 601 is arranged at an intersection of the second branch channel 220, the first path 261, and the second path 262. A second switching member 602 is arranged at an intersection of the fifth path 231, the second path 262, and the third path 263. A third switching member 603 is arranged at in intersection of the third path 263, the fourth path 264, and the fourth branch channel 240. A fourth switching member 604 is arranged at an intersection of the first path 261, the fourth path 264, and the fifth branch channel 250. A fifth switching member 605 is arranged at an intersection of the fifth path 231, the sixth path 232, and the banknote recycling channel 300. A sixth switching member 606 is arranged at an intersection of the fourth branch channel 240 and the banknote circulation channel 400. In the present embodiment, the above switching members are all rotary switching members.

Figure 6:
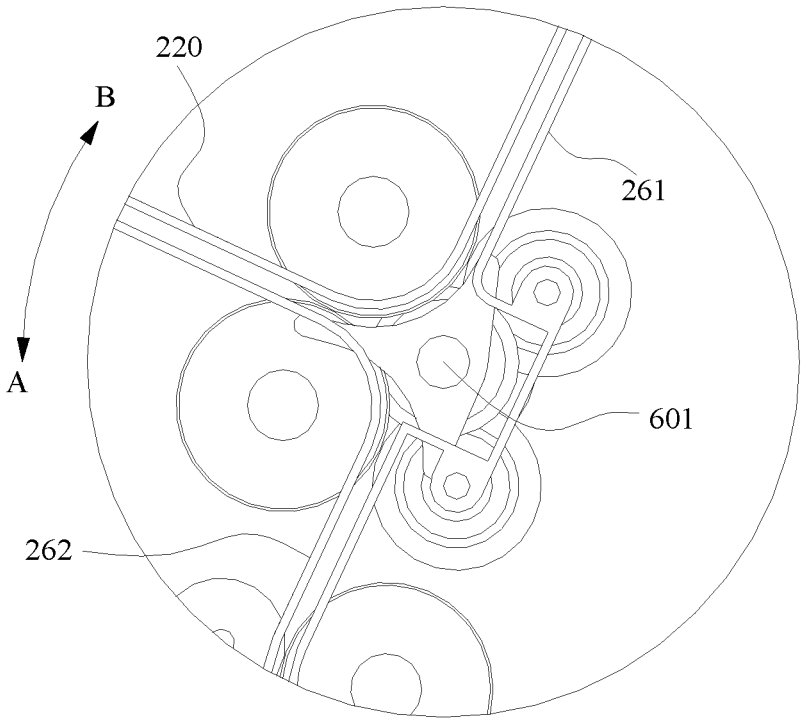
FIG. 6 is an enlarged partial structural schematic view of a first switching member of an automatic teller machine in accordance with one embodiment.

Referring to FIG. 6, which is an enlarged partial structural schematic view of a first switching member 601 in FIG. 5. When the first switching member 601 rotates by a set angle in an A direction in FIG. 6, the second branch channel 220 is in communication with the first path 261, and the banknote can enter the first path 261 from the second branch channel 220 at this moment. When the first switching member 601 rotates by a set angle in a B direction in FIG. 6, the second branch channel 220 is in communication with the second path 262, and the banknote can enter the second branch channel 220 from the second path 262 at this moment.

Figure 7:
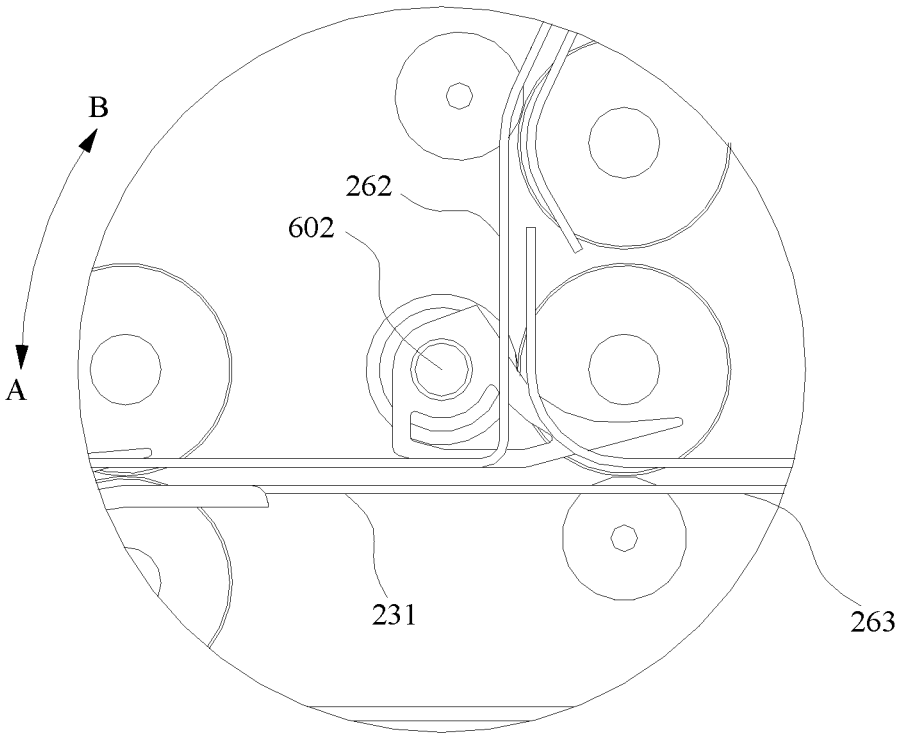
FIG. 7 is an enlarged partial structural schematic view of a second switching member of an automatic teller machine in accordance with one embodiment.

Referring to FIG. 7, FIG. 7 is an enlarged partial structural schematic view of a second switching member 602 in FIG. 5. When the second switching member 602 rotates by a set angle in the A direction in FIG. 7, the fifth path 231 is in communication with the third path 263, and the banknote can enter the fifth path 231 from the third path 263 at this moment. When the second switching member 602 rotates by a set angle in the B direction in FIG. 7, the second path 262 is in communication with the third path 263, and the banknote can enter the second path 262 from the third path 263 at this moment.

Figure 8:
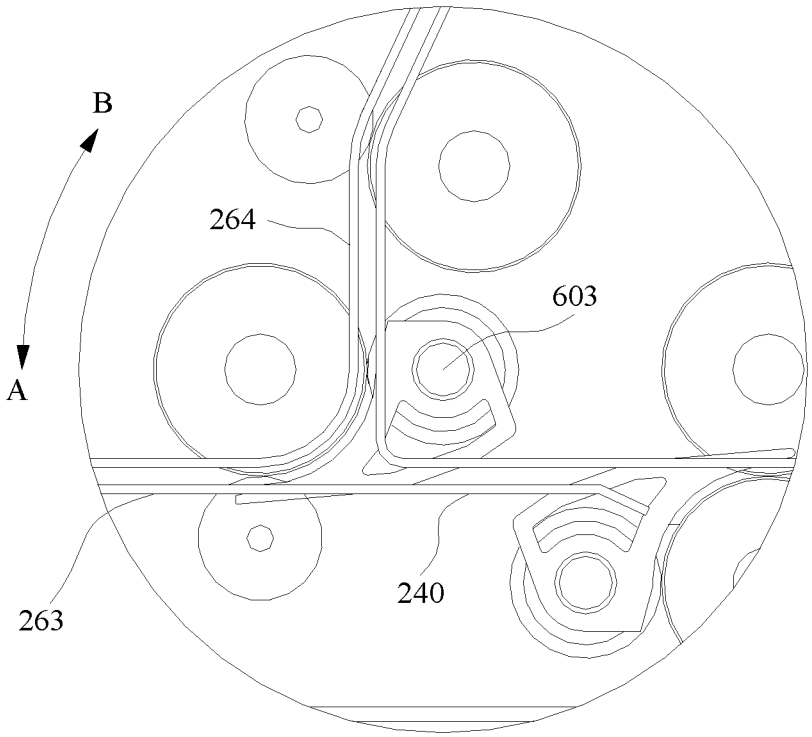
FIG. 8 is an enlarged partial structural schematic view of a third switching member of an automatic teller machine in accordance with one embodiment.

Referring to FIG. 8, FIG. 8 is an enlarged partial structural schematic view of a third switching member 603 in FIG. 5. When the third switching member 603 rotates by a set angle in the A direction in FIG. 8, the third path 263 is in communication with the fourth path 264, and the banknote can enter the third path 263 from the fourth path 264 at this moment. When the third switching member 603 rotates by a set angle in the B direction in FIG. 8, the fourth branch channel 240 is in communication with the third path 263, and the banknote can enter the third path 263 from the fourth branch channel 240 at this moment.

Figure 9:
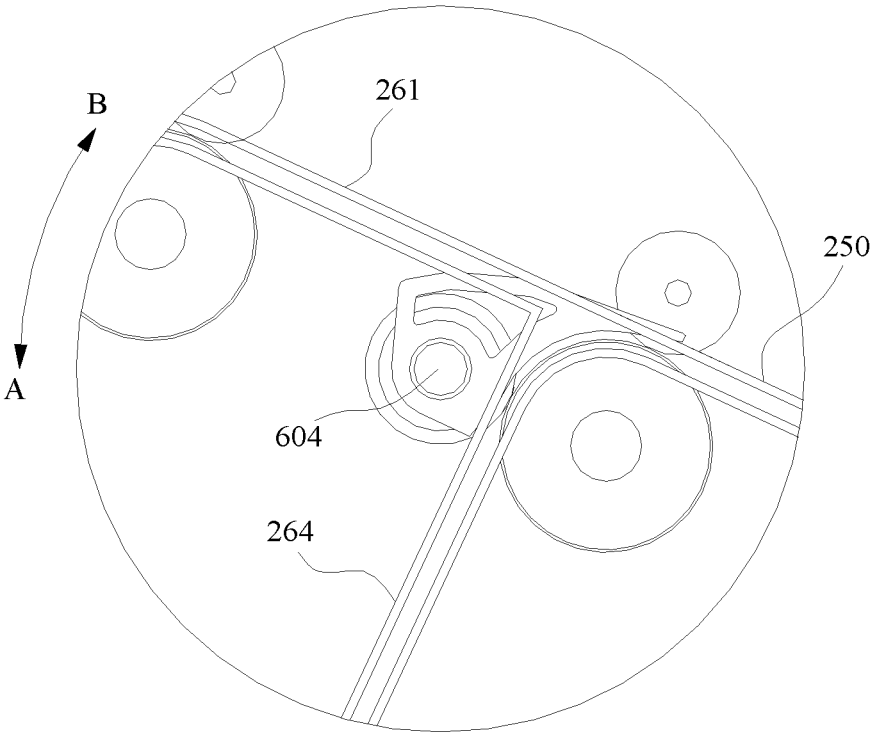
FIG. 9 is an enlarged partial structural schematic view of a fourth switching member of an automatic teller machine in accordance with one embodiment.

Referring to FIG. 9, FIG. 9 is an enlarged partial structural schematic view of a fourth switching member 604 in FIG. 5. When the fourth switching member 604 rotates by a set angle in the A direction in FIG. 9, the fourth path 264 is in communication with the fifth branch channel 250, and the banknote can enter the fourth path 264 from the fifth branch channel 250 at this moment. When the fourth switching member 604 rotates by a set angle in the B direction in FIG. 9, the first path 261 is in communication with the fifth branch channel 250, and the banknote can enter the fifth branch channel 250 from the first path 261 at this moment.

Figure 10:
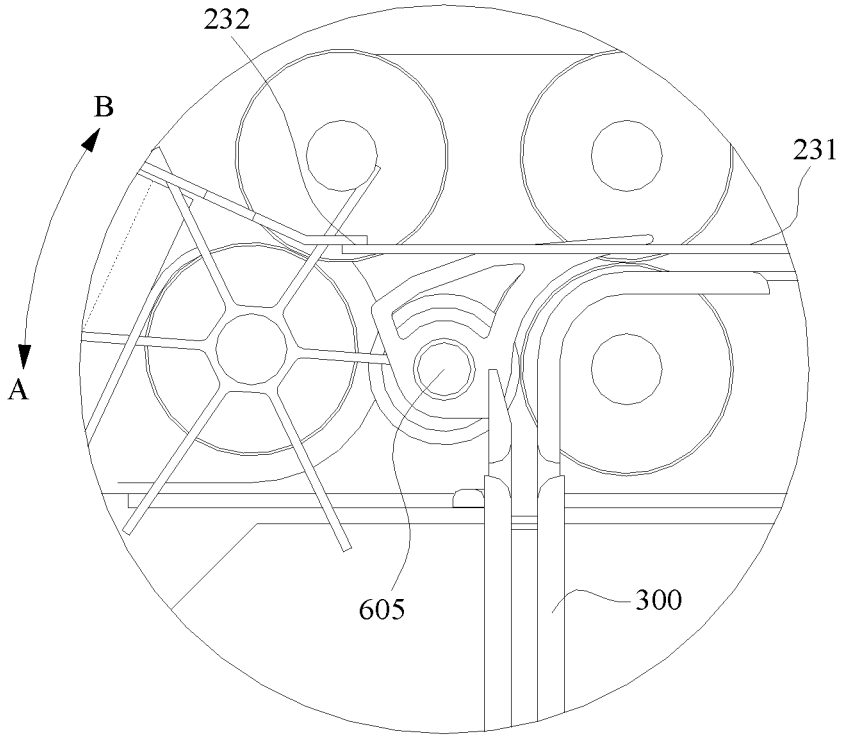
FIG. 10 is an enlarged partial structural schematic view of a fifth switching member of an automatic teller machine in accordance with one embodiment.

Referring to FIG. 10, FIG. 10 is an enlarged partial structural schematic view of a fifth switching member 605 in FIG. 5. When the fifth switching member 605 rotates by a set angle in the A direction in FIG. 10, the fifth path 231 is in communication with the banknote recycling channel 300, and the banknote can enter the banknote recycling channel 300 from the fifth path 231 at this moment. When the fifth switching member 605 rotates by a set angle in the B direction in FIG. 10, the fifth path 231 is in communication with the sixth path 232, and the banknote can enter the sixth path 232 from the fifth path 231 at this moment.

Figure 11:
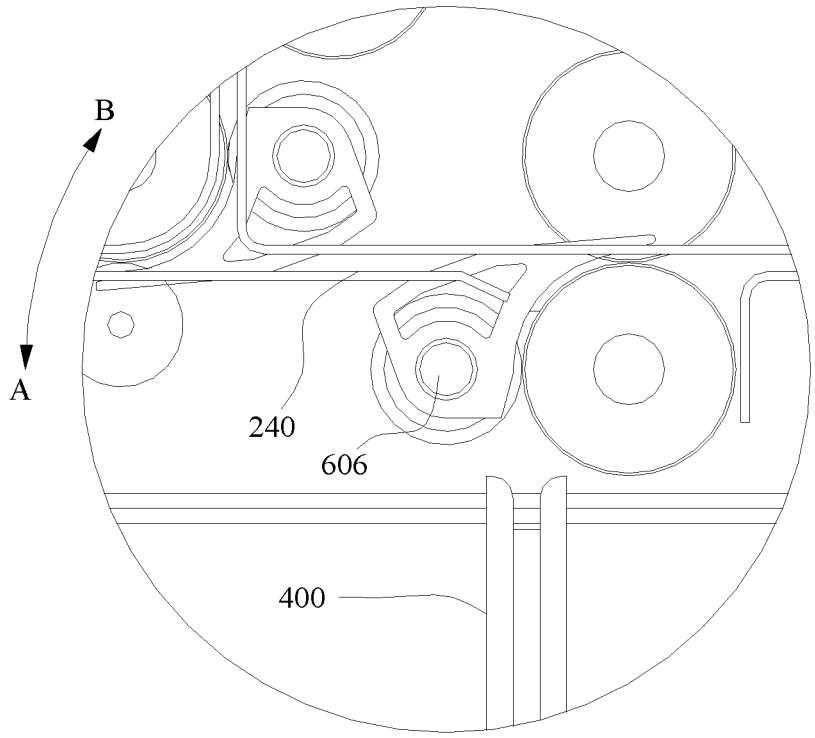
FIG. 11 is an enlarged partial structural schematic view of a sixth switching member of an automatic teller machine in accordance with one embodiment.

Referring to FIG. 11, FIG. 11 is an enlarged partial structural schematic view of a sixth switching member 606 in FIG. 5. When the sixth switching member 606 rotates by a set angle in the A direction in FIG. 11, the fourth branch channel 240 is blocked, and the banknote circulation channel 400 is in communication with the fourth branch channel 240, and the banknote can move between the banknote circulation channel 400 and the fourth branch channel 240 at this moment. When the sixth switching member 606 rotates by a set angle in the B direction in FIG. 11, the fourth branch channel 240 is opened, and the banknote can move in the fourth branch channel 240 at this moment.

The following is an illustration of the working process of depositing and withdrawing cash on the automatic teller machine 10 provided by the present embodiment with reference made to FIG. 4 and FIG. 5.

When performing a deposit, the banknote enters the first path 261 from the banknote-in mechanism 110 through the first branch channel 210, moves in the first path 261 along the clockwise direction (namely, the preset direction) in the drawings, enters the fifth branch channel 250 under the guidance of the fourth switching member 604, and then enters the identification mechanism 140 along the fifth branch channel 250. After being identified by the identification mechanism 140, the banknote moves along the fourth branch channel 240, enters the third path 263 under the guidance of the third switching member 603, and then moves in the third path 263 along the clockwise direction (namely, the preset direction) in the drawings. The banknote that is identified by the identification mechanism 140 as a qualified banknote (real banknote) would then enter the second path 262 under the guidance of the second switching member 602, then enter the second branch channel 220 under the guidance of the first switching member 601, and then move to the temporary storage mechanism 120 along the second branch channel 220. The banknote that is identified by the identification mechanism 140 as an unqualified banknote (a counterfeit or tampered banknote) would enter the fifth path 231 under the guidance of the second switching member 602, then enter the sixth path 232 under the guidance of the fifth switching member 605, and then enter the banknote-out mechanism 130 along the sixth path 232. The second door 131 of the banknote-out mechanism 130 would then be opened, awaiting the user to take away the unqualified banknote.

When the banknote deposit operation is cancelled, the first door 121 of the temporary storage mechanism 120 would be opened, awaiting the user to take away the banknote in the temporary storage mechanism 120.

When the banknote deposit operation is confirmed, the banknote would enter the second branch channel 220 from the temporary storage mechanism 120, then enter the first path 261 under the guidance of the first switching member 601, and then move in the first path 261 along the clockwise direction (namely, the preset direction) in the drawings. The banknote then enters the fifth branch channel 250 from the first path 261 under the guidance of the fourth switching member 604, and then enters the identification mechanism 140 along the fifth branch channel 250. After being identified by the identification mechanism 140, the banknote would enter the fourth branch channel 240. The banknote that is identified by the identification mechanism 140 as a qualified banknote (the banknote suitable for circulation) would enter the banknote circulation channel 400 under the guidance of the sixth switching member 606, and then enter the circulation box 150 along the banknote circulation channel 400. The banknote that is identified by the identification mechanism 140 as an unqualified banknote (namely a banknote that is unsuitable for circulation, such as an old version banknote or a damaged banknote) would then enter the recycling box 160 through the fourth branch channel 240, the third path 263, the fifth path 231, and the banknote recycling channel 300 under the guidance of the sixth switching member 606, the third switching member 603, the second switching member 602 and the fifth switching member 605 in sequence.

In withdrawing banknotes, the banknote in the circulation box 150 enters the fourth branch channel 240 through the banknote circulation channel 400 under the guidance of the sixth switching member 606, and then enters the identification mechanism 240 along the fourth branch channel 240. After being identified, the banknote would enter the fifth branch channel 250, then enter the fourth path 264 under the guidance of the fourth switching member 604, moves in the fourth path 264 along the clockwise direction (namely, the preset direction) in the drawings, enters the third path 263 from the fourth path 264 under the guidance of the third switching member 603, moves in the third path 263 along the clockwise direction (namely, the preset direction) in the drawings, and then enters the fifth path 231 under the guidance of the second switching member 602. The banknote that is identified by the identification mechanism 140 as an unqualified banknote (namely a banknote that is unsuitable for circulation, such as an old version banknote or a damaged banknote) would enter the banknote recycling channel 300 under the guidance of the fifth switching member 605, and then enter the recycling box 160 along the banknote recycling channel 300. The banknote that is identified by the identification mechanism 140 as a qualified banknote (namely a banknote that is suitable for circulation) would enter the sixth path 232 under the guidance of the fifth switching member 605, and then enter the banknote-out mechanism 130 along the sixth path 232. The second door 131 of the banknote-out mechanism 130 would then be opened, awaiting the user to take away the banknote in the banknote-out mechanism 130.

According to the automatic teller machine 10 provided by the present embodiment, the banknote-in mechanism 110, the temporary storage mechanism 120, the banknote-out mechanism 130, and the identification mechanism 140 are all connected to the annular channel 260. In both banknote deposit and withdrawal operations, the banknote can unidirectionally move in the annular channel 260 along the clockwise direction (namely, the preset direction) in the drawings, so that the banknote can be circulated between the banknote-in mechanism 110, the temporary storage mechanism 120, the banknote-out mechanism 130, the identification mechanism 140, the circulation box 150 and the recycling box 160, thereby reducing the probability of jamming during banknote conveyance and thus improving the banknote processing efficiency.

Figure 12:
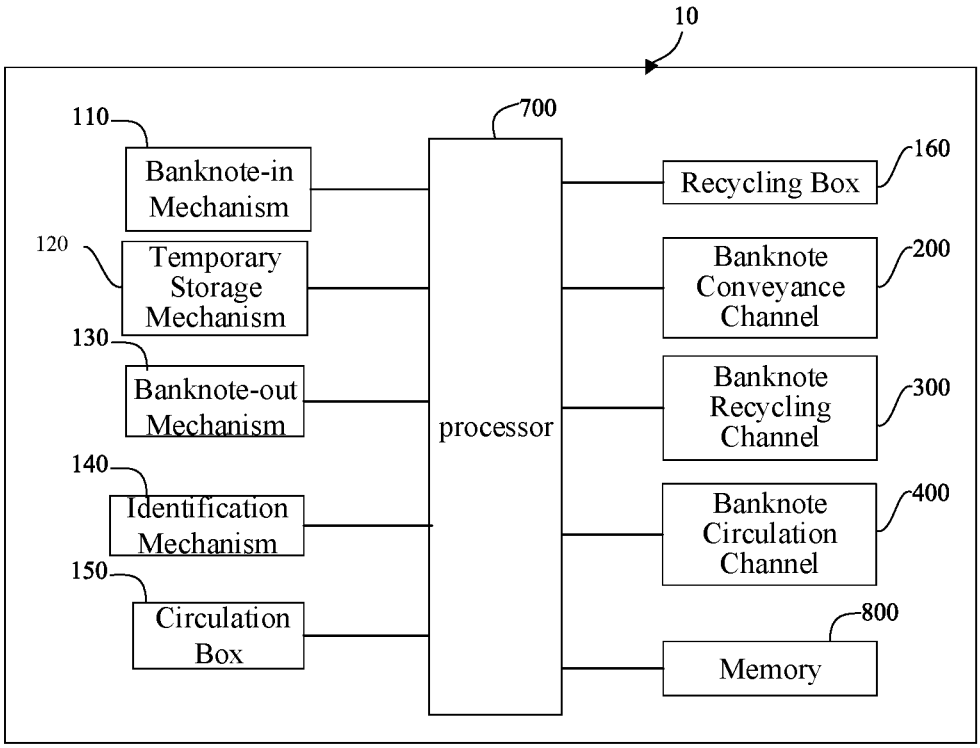
FIG. 12 is an electrical schematic diagram of a banknote processing device in accordance with one embodiment.

Referring to FIG. 12, on the basis of the above embodiments, the automatic teller machine 10 may further include a processor 700 and a memory 800.

The processor 700 is configured to control the operation of the banknote-in mechanism 110, the temporary storage mechanism 120, the banknote-out mechanism 130, the identification mechanism 140, the circulation box 150, the recycling box 160, the banknote conveyance channel 200, the banknote recycling channel 300, and the banknote circulation channel 400, to perform banknote processing method that follows.

The memory 800 may include a program storage area and a data storage area. The program storage area may be configured to store an appliance program that is needed to serve at least one function as well as an operation system. The data storage area may be configured to store data generated by use of the deposit machine and the like. Furthermore, the memory 800 may include a volatile memory such as a random access memory, and may further include a non-volatile memory, such as at least one selected from the group consisting of a disk storage device, a flash memory device, or other non-transitory solid state storage devices.

A banknote processing method is further provided by one embodiment of the present disclosure. The banknote processing method provided by this embodiment may be realized based on the automatic teller machine 10 provided by the above embodiment.

The banknote processing method includes at least one of the following steps, referring to FIG. 4 and FIG. 5.

The steps of banknote deposit are as the following process. The banknote enters the annular channel 260 from the banknote-in mechanism 110 through the first branch channel 210, then enters the fifth branch channel 250 through the annular channel 260, and then enters the identification mechanism 140 along the fifth branch channel 250. After being identified by the identification mechanism 140, the banknote enters the annular channel 260 along the fourth branch channel 240. If the banknote is identified by the identification mechanism 140 to be a qualified banknote (a real banknote), then it would enter the second branch channel 220 through the annular channel 260, and then enter the temporary storage mechanism 120 along the second branch channel 220. If the banknote is identified by the identification mechanism 140 as an unqualified banknote (a counterfeit or tampered banknote), then the banknote would enter the third branch channel 230 through the annular channel 260, and then enter the banknote-out mechanism 130 along the third branch channel 230.

When the banknote deposit operation is cancelled, the first door 121 of the temporary storage mechanism 120 would be opened.

When the banknote deposit operation is confirmed, the banknote would enter the annular channel 260 from the temporary storage mechanism 120 through the second branch channel 220, then enter the fifth branch channel 250 through the annular channel 260, and then enter the identification mechanism 140 along the fifth branch channel 250. If the banknote is identified by the identification mechanism 140 as a qualified banknote (a banknote suitable for circulation) would enter the banknote circulation channel 400 through the banknote conveyance channel 200, and then enter the circulation box 150 along the banknote circulation channel 400. If the banknote is identified by the identification mechanism 140 as an unqualified banknote (a counterfeit or tampered banknote), then the banknote would enter the banknote recycling channel 300 through the banknote conveyance channel 200, and then enter the recycling box 160 along the banknote recycling channel 300.

The steps of banknote withdrawal are as follows. The banknote enters the banknote conveyance channel 200 from the circulation box 150 through the banknote circulation channel 400, and then enters the identification mechanism 140 along the banknote conveyance channel 200. If the banknote is identified by the identification mechanism 140 as a qualified banknote (a banknote suitable for circulation), then the banknote would enter the annular channel 260 through the fifth branch channel 250, then enter the third branch channel 230 through the annular channel 260, and then enter the banknote-out mechanism 130 along the third branch channel 230. If the banknote is identified by the identification mechanism 140 as an unqualified banknote (a banknote unsuitable for circulation, such as an old version banknote or a damaged banknote), then the banknote would enter the annular channel 260 through the banknote conveyance channel 200, then enter the banknote recycling channel 300 through the annular channel 260, and then enter the recycling box 160 along the banknote recycling channel 300.

In the above steps, when the banknote is in the annular channel 260, the banknote moves in the annular channel 260 along the clockwise direction (namely, the preset direction) in the drawings.

Referring to FIG. 4 and FIG. 5, in order to reduce the length of the moving path during the banknote circulation, in the steps of the banknote deposit, the banknote that is identified by the identification mechanism 140 as a qualified banknote (a banknote suitable for circulation) may enter the banknote circulation channel 400 through the fourth branch channel 240; the banknote that is identified by the identification mechanism 140 as an unqualified banknote (a banknote unsuitable for circulation, such as an old version banknote or a damaged banknote) would enter the annular channel 260 through the fourth branch channel 240, then enter the third branch channel 230 through the annular channel 260, and then enter the banknote recycling channel 300 along the third branch channel 230.

Referring to FIG. 4 and FIG. 5, in order to reduce the length of the moving path during the banknote circulation, in the steps of the banknote withdrawal, the banknote may enter the fourth branch channel 240 from the circulation box 150 through the banknote circulation channel 400, and then enter the identification mechanism 140 along the fourth branch channel 240. The banknote that is identified by the identification mechanism 140 as an unqualified banknote (a banknote unsuitable for circulation, such as an old version banknote or a damaged banknote) may enter the annular channel 260 through the fifth branch channel 250, then enter the third branch channel 230 through the annular channel 260, and then enter the banknote recycling channel 300 along the third branch channel 230.

The following is a further illustration of the banknote processing method with reference made to FIG. 4 and FIG. 5.

The steps of banknote deposit are as follows. The banknote enters the first path 261 from the banknote-in mechanism 110 through the first branch channel 210, then moves in the first path 261 along the clockwise direction (namely, the preset direction) in the drawings, then enters the fifth branch channel 250 under the guidance of the fourth switching member 604, and then enters the identification mechanism 140 along the fifth branch channel 250. After being identified by the identification mechanism 140, the banknote moves along the fourth branch channel 240, enters the third path 263 under the guidance of the third switching member 603, and then moves in the third path 263 along the clockwise direction (namely, the preset direction) in the drawings. The banknote that is identified by the identification mechanism 140 as a qualified banknote (a real banknote) enters into the second path 262 under the guidance of the second switching member 602, then enters the second branch channel 220 under the guidance of the first switching member 601, and then enters the temporary storage mechanism 120 along the second branch channel 220. The banknote that is identified by the identification mechanism 140 as an unqualified banknote (a banknote unsuitable for circulation, such as an old version banknote or a damaged banknote) would enter the fifth path 231 under the guidance of the second switching member 602, then enter the sixth path 232 under the guidance of the fifth switching member 605, and then enter the banknote-out mechanism 130 along the sixth path 232. The second door 131 of the banknote-out mechanism 130 would then be opened, awaiting the user to take away the unqualified banknote.

When the banknote deposit operation is canceled, the first door 121 of the temporary storage mechanism 120 would be opened, awaiting the user to take away the banknote in the temporary storage mechanism 120.

When the banknote deposit operation is confirmed, the banknote would then enter the second branch channel 220 from the temporary storage mechanism 120, then enter the first path 261 under the guidance of the first switching member 601, and then move in the first path 261 along the clockwise direction (namely, the preset direction) in the drawings, enter the fifth branch channel 250 from the first path 261 under the guidance of the fourth switching member 604, and enter the identification mechanism 140 along the fifth branch channel 250. After being identified by the identification mechanism 140, the banknote enters the fourth branch channel 240. The banknote that is identified by the identification mechanism 140 as a qualified banknote (a banknote suitable for circulation) would enter the banknote circulation channel 400 under the guidance of the sixth switching member 606, and then enter the circulation box 150 along the banknote circulation channel 400. The banknote that is identified by the identification mechanism 140 as an unqualified banknote (a banknote unsuitable for circulation, such as an old version banknote or a damaged banknote) would enter the recycling box 160 through the fourth branch channel 240, the third path 263, the fifth path 231, and the banknote recycling channel 300 under the guidance of the sixth switching member 606, the third switching member 603, the second switching member 602 and the fifth switching member 605 in sequence.

The steps of banknote withdrawals are as follows. The banknote in the circulation box 150 enters the fourth branch channel 240 through the banknote circulation channel 400 under the guidance of the sixth switching member 606, and then enters the identification mechanism 140 along the fourth branch channel 240. After being authenticated, the banknote would enter the fifth branch channel 250, then enter the fourth path 264 under the guidance of the fourth switching member 604, then move in the fourth path 264 along the clockwise direction (namely, the preset direction) in the drawings, enter the third path 263 through the fourth path 264 under the guidance of the third switching member 603, move in the third path 263 along the clockwise direction (namely, the preset direction) in the drawings, and then enter the fifth path 231 under the guidance of the second switching member 602. The banknote that is identified by the identification mechanism 140 as an unqualified banknote (the banknote unsuitable for circulation, such as an old version banknote or a damaged banknote) would enter the banknote recycling channel 300 under the guidance of the fifth switching member 605, and then enter the recycling box 160 along the banknote recycling channel 300. The banknote that is identified by the identification mechanism 140 as a qualified banknote (a banknote suitable for circulation) would enter the sixth path 232 under the guidance of the fifth switching member 605, and then enter the banknote-out mechanism 130 along the sixth path 232. The second door 131 of the banknote-out mechanism 130 would then be opened, awaiting the user to take away the banknote in the banknote-out mechanism 130. According to the banknote processing method provided by the present embodiment, when the banknote is in the annular channel 260, the banknote can move unidirectionally in the annular channel 260 along the clockwise direction (namely, the preset direction) in the drawings, so that the banknote can be circulated between the banknote-in mechanism 110, the temporary storage mechanism 120, the banknote-out mechanism 130, the identification mechanism 140, the circulation box 150, and the recycling box 160, thereby reducing the probability of jamming during the banknote conveyance and improving the banknote processing efficiency.

One embodiment of the present disclosure further provides a computer readable storage medium, which stores computer executable instructions configured to perform the above banknote processing method.

INDUSTRIAL APPLICABILITY

The automatic teller machine provided by the present disclosure reduces the probability of jamming during the banknote conveyance and improves the banknote processing efficiency.

The invention claimed is:

1. An automatic teller machine, comprising:
a banknote-in mechanism,
a temporary storage mechanism,
a banknote-out mechanism,
an identification mechanism,
a circulation box,
a recycling box,
a banknote conveyance channel,
a banknote recycling channel, and
a banknote circulation channel,
wherein the banknote conveyance channel comprises an annular channel, a first branch channel, a second branch channel, a third branch channel, a fourth branch channel, and a fifth branch channel;
wherein the banknote-in mechanism is in communication with the annular channel through the first branch channel;
wherein the temporary storage mechanism is in communication with the annular channel through the second branch channel;
wherein the banknote-out mechanism is in communication with the annular channel through the third branch channel;
wherein a first end of the identification mechanism is in communication with the annular channel through the fourth branch channel, and a second end of the identification mechanism is in communication with the annular channel through the fifth branch channel;
wherein the recycling box is in communication with the banknote conveyance channel through the banknote recycling channel; and
wherein the circulation box is in communication with the banknote conveyance channel through the banknote circulation channel;
wherein the annular channel is configured to make a banknote to unidirectionally move in the annular channel along a preset direction;
wherein the fifth branch channel, the fourth branch channel, the third branch channel, the second branch channel, and the first branch channel are in communication with the annular channel in sequence along the preset direction.

2. The automatic teller machine according to claim 1, wherein at least one selected from a group consisting of the banknote-in mechanism, the temporary storage mechanism, and the banknote-out mechanism is located outside of the annular channel.

3. The automatic teller machine according to claim 2, wherein the recycling box is in communication with the third branch channel through the banknote recycling channel.

4. The automatic teller machine according to claim 2, wherein the circulation box is in communication with the fourth branch channel through the banknote circulation channel.

5. The automatic teller machine according to claim 1,
wherein the annular channel comprises a fourth path, a third path, a second path, and a first path which are connected end to end along the preset direction;
wherein the first branch channel and the first path intersect; the second branch channel, the first path, and the second path intersect; the third branch channel, the second path, and the third path intersect;
wherein the third path, the fourth path and the fourth branch channel intersect; the first path, the fourth path, and the fifth branch channel intersect.

6. The automatic teller machine according to claim 5, further comprising:
at least one selected from a group consisting of a first switching member, a second switching member, a third switching member, a fourth switching member, a fifth switching member, and a sixth switching member,
wherein the first switching member is arranged at an intersection of the second branch channel and the annular channel; the first switching member is configured to communicate the second branch channel with a portion of the annular channel located at a first side of the second branch channel, or communicate the second branch channel with a portion of the annular channel located at a second side of the second branch channel;

wherein the third branch channel comprises a fifth path, and the second switching member is arranged at an intersection of the fifth path, the second path, and the third path; the second switching member is configured to communicate the fifth path and the third path, or communicate the second path with the third path;

wherein the third switching member is arranged at an intersection of the fourth branch channel, the third path, and the fourth path; the third switching member is configured to communicate the third path with the fourth path, or communicate the fourth branch channel and the third path;

wherein the fourth switching member is arranged at an intersection of the fifth branch channel and the annular channel; the fourth switching member is configured to communicate the fifth branch channel with a portion of the annular channel located at a first side of the fifth branch channel, or communicate the fifth branch channel with a portion of the annular channel located at a second side of the fifth branch channel;

wherein the fifth switching member is arranged at an intersection of the banknote recycling channel and the banknote conveyance channel; the fifth switching member is configured to block off the banknote conveyance channel, or block off a communication between the banknote recycling channel and the banknote conveyance channel; and wherein the sixth switching member is arranged at an intersection of the banknote circulation channel and the banknote conveyance channel; the sixth switching member is configured to block off the banknote conveyance channel, or block off a communication between the banknote circulation channel and the banknote conveyance channel.

7. The automatic teller machine according to claim 6, wherein at least one selected from a group consisting of a first switching member, a second switching member, a third switching member, a fourth switching member, a fifth switching member, and a sixth switching member is a rotary switching member.

8. The automatic teller machine according to claim 5, wherein the recycling box is in communication with the third branch channel through the banknote recycling channel.

9. The automatic teller machine according to claim 1, wherein the recycling box is in communication with the third branch channel through the banknote recycling channel.

10. The automatic teller machine according to claim 9, wherein the third branch channel comprises a fifth path and a sixth path;

wherein a first end of the fifth path, a first end of the sixth path, and the banknote recycling channel intersect;

wherein a second end of the fifth path and the annular channel intersect;

wherein a second end of the sixth path is in communication with the banknote-out mechanism.

11. The automatic teller machine according to claim 1, wherein the circulation box is in communication with the fourth branch channel through the banknote circulation channel.

12. The automatic teller machine according to claim 1, wherein the recycling box is in communication with the third branch channel through the banknote recycling channel.

13. The automatic teller machine according to claim 1, wherein the recycling box is in communication with the third branch channel through the banknote recycling channel.

14. The automatic teller machine according to claim 1, wherein the circulation box is in communication with the fourth branch channel through the banknote circulation channel.

15. The automatic teller machine according to claim 1, wherein the circulation box is in communication with the fourth branch channel through the banknote circulation channel.

16. A banknote processing method, implemented on the basis of an automatic teller machine, wherein the automatic teller machine comprises a banknote-in mechanism, a temporary storage mechanism, a banknote-out mechanism, an identification mechanism, a circulation box, a recycling box, a banknote conveyance channel, a banknote recycling channel, and a banknote circulation channel, wherein the banknote conveyance channel comprises an annular channel, a first branch channel, a second branch channel, a third branch channel, a fourth branch channel, and a fifth branch channel;

wherein the banknote-in mechanism is in communication with the annular channel through the first branch channel;

wherein the temporary storage mechanism is in communication with the annular channel through the second branch channel;

wherein the banknote-out mechanism is in communication with the annular channel through the third branch channel;

wherein a first end of the identification mechanism is in communication with the annular channel through the fourth branch channel, and a second end of the identification mechanism is in communication with the annular channel through the fifth branch channel;

wherein the recycling box is in communication with the banknote conveyance channel through the banknote recycling channel;

wherein the circulation box is in communication with the banknote conveyance channel through the banknote circulation channel;

wherein the annular channel is configured to make a banknote to unidirectionally move in the annular channel along a preset direction;

wherein the fifth branch channel, the fourth branch channel, the third branch channel, the second branch channel, and the first branch channel are in communication with the annular channel in sequence along the preset direction;

wherein the banknote processing method comprises banknote deposit steps or banknote withdrawal steps, wherein a banknote moves unidirectionally all along in the annular channel along a preset direction when the banknote is located in the annular channel;

wherein the banknote deposit steps comprise the following process in which:

the banknote enters the annular channel from the banknote-in mechanism through the first branch channel;

the banknote enters the fifth branch channel through the annular channel, and then enters the identification mechanism along the fifth branch channel;

after being identified by the identification mechanism, the banknote enters the annular channel along the fourth branch channel;

in response to the banknote being identified by the identification mechanism as meeting a first preset condition, the banknote enters the second branch channel through the annular channel, and then enters the temporary storage mechanism along the second branch channel;

in response to the banknote being identified by the identification mechanism as not meeting the first preset condition, the banknote enters the third branch channel through the annular channel, and then enters the banknote-out mechanism along the third branch channel;

when the banknote deposit is canceled, a door of the temporary storage mechanism is opened;

when the banknote deposit is confirmed, the banknote enters the annular channel from the temporary storage mechanism through the second branch channel; the banknote enters the fifth branch channel through the annular channel, and then enters the identification mechanism along the fifth branch channel;

in response to the banknote being identified by the identification mechanism as meeting the second preset condition, the banknote enters the banknote circulation channel through the banknote conveyance channel, and then enters the circulation box along the banknote circulation channel;

in response to the banknote being identified by the identification mechanism as not meeting the second preset condition, the banknote enters the annular channel through the banknote conveyance channel, and then enters the banknote recycling channel along the annular channel, and then enters the recycling box along the banknote recycling channel;

wherein the banknote withdrawal steps comprise a following process in which:

the banknote enters the banknote conveyance channel from the circulation box through the banknote circulation channel, and then enters the identification mechanism along the banknote conveyance channel;

in response to the banknote being identified by the identification mechanism as meeting the second preset condition, the banknote enters the annular channel through the fifth branch channel, and then enters the third branch channel through the annular channel, and then enters the banknote-out mechanism along the third branch channel;

in response to the banknote being identified by the identification mechanism as not meeting the second preset condition, the banknote enters the annular channel through the banknote conveyance channel, and then enters the banknote recycling channel along the annular channel, and then enters the recycling box along the banknote recycling channel.

17. The banknote processing method according to claim 16, wherein the banknote deposit steps further comprise at least one selected from a group consisting of following options:

in response to the banknote being identified by the identification mechanism as meeting the first preset condition, the banknote enters the banknote circulation channel through the fourth branch channel; and in response to the banknote being identified by the identification mechanism as not meeting the first preset condition, the banknote enters the annular channel through the fourth branch channel, and then enters the third branch channel through the annular channel, and then enters the banknote recycling channel along the third branch channel;

wherein in the banknote withdrawal steps, a process in which the banknote enters the banknote conveyance channel from the circulation box through the banknote circulation channel, then enters the identification mechanism along the banknote conveyance channel comprises a process in which the banknote enters the fourth branch channel from the circulation box through the banknote circulation channel, and then enters the identification mechanism along the fourth branch channel; and wherein a process of in response to the banknote being identified by the identification mechanism as not meeting the second preset condition, the banknote enters the annular channel through the banknote conveyance channel, and then enters the banknote recycling channel along the annular channel, and then enters the recycling box along the banknote recycling channel comprises a following process in which:

in response to the banknote being identified by the identification mechanism as not meeting the second preset condition, the banknote enters the annular channel through the fifth branch channel, and then enters the third branch channel through the annular channel, and then enters the banknote recycling channel along the third branch channel.

18. A non-transitory computer readable storage medium, storing a computer executable instruction configured to perform the method according to claim 16.

* * * * *